US005517789A

United States Patent [19]

Sugiyama

[11] Patent Number: 5,517,789

[45] Date of Patent: May 21, 1996

[54] VARIABLE FLOOR HEIGHT TELESCOPIC MULTI-STAGED SPECTATOR SEATING SYSTEM

[75] Inventor: Noboru Sugiyama, Tokyo, Japan

[73] Assignee: Kabushiki Kaisha Kotobuki, Tokyo, Japan

[21] Appl. No.: 327,288

[22] Filed: Oct. 21, 1994

[30] Foreign Application Priority Data

Oct. 22, 1993 [JP] Japan ..... 5-298857

[51] Int. Cl.[6] ..... E04H 3/12

[52] U.S. Cl. ..... 52/10; 52/8; 52/9; 297/257

[58] Field of Search ..... 52/8, 9, 10; 297/257, 297/331, 344.1

[56] References Cited

U.S. PATENT DOCUMENTS

| | | | |
|---|---|---|---|
| 3,025,106 | 3/1962 | Evans et al. | 52/9 X |
| 4,879,849 | 11/1989 | Hollingsworth, III et al. | 52/10 |
| 5,228,246 | 7/1993 | Suzuki et al. | 52/9 |

OTHER PUBLICATIONS

Popular Mechanics, vol. 96, Issue 4, Oct. 1951, p. 133.

*Primary Examiner*—Wynn E. Wood
*Assistant Examiner*—W. Glenn Edwards
*Attorney, Agent, or Firm*—Oldham & Oldham Co.

[57] ABSTRACT

To assure that each spectator sitting on his seat enjoys a performance in a theater or the like at his desired height, a floor height adjusting mechanism is mounted on each of a plurality of movable platforms constituting a variable floor height telescopic multi-staged spectator seating system. Usually, the floor height adjusting mechanism is constructed in the form of a threaded shaft driving unit which is composed of a motor, a threaded shaft adapted to be rotationally driven by the motor, and a support column fixedly secured to each movable platform. The lowermost end of the support column is operatively connected to the lowermost end of the threaded shaft for rotatably holding the threaded shaft. Otherwise, the floor height adjusting mechanism is constructed in the form of a combination of a threaded shaft driving unit with a moving pulley unit, and this type of floor height adjusting mechanism is preferably employable for a lowermost movable platform which requires that an adjustable height can be increased.

4 Claims, 8 Drawing Sheets

VARIABLE FLOOR HEIGHT TELESCOPIC MULTI-STAGED SPECTATOR SEATING SYSTEM

BACKGROUND OF THE INVENTION

1. Field of the Invention

The present invention relates generally to a variable floor height telescopic multi-staged spectator seating system usable in a theater, an athletic stadium or the like. More particularly, the present invention relates to a variable floor height telescopic multi-staged spectator seating system of the foregoing type including a plurality of movable platforms each having a variable floor height.

2. Description of the Related Art

A typical conventional movable platform type spectator seating system is disclosed in an official gazette of Japanese Utility Model Laid-Open Publication NO. 63-171561. According to this prior invention, the spectator seating system includes a plurality of movable platforms arranged in the spaced relationship as seen in the upward and downward directions, and one end of each movable platform is secured via a support arm to a support column adapted to be raised up and lowered by a raising and lowering power cylinder to change the floor height of each movable platform as desired. In addition, a tilting power cylinder is operatively connected to the support arm so as to change the tilting angle of the support arm in order to assure that the height of an upper movable platform as measured from a lower movable platform is kept constant with respect to all the movable platforms. However, this conventional spectator seating system has problems as noted below. One of the problems is that it is impossible to individually change the floor height of each movable platform. The other problem is that the floor height changing mechanism arranged for each movable platform is complicated in structure and requires a large space for mounting it in the spectator seating system.

SUMMARY OF THE INVENTION

The present invention has been made in consideration of the aforementioned background.

An object of the present invention is to provide a variable floor height telescopic multi-staged spectator seating system which assures that the height of each of a plurality of movable platforms can be adjusted as desired.

Another object of the present invention is to provide a variable floor height telescopic multi-staged spectator seating system in which the lowermost movable platform is adjustable by the use of a combination of a driven threaded rod and a pulley.

According to the present invention, there is provided a variable floor height telescopic multi-staged spectator seating system which comprises a plurality of movable platforms of which heights as measured from the floor surface are successively increased, and moreover, can be changed as desired. The movable platforms may successively be expanded one after another in the forward direction when the spectator seating system is practically used and successively contracted one after another in the rearward direction when the spectator seating system is not used. A plurality of movable wagons are adapted to be successively connected one after another while supporting the movable platforms in the raised state or in the lowered state. Each of the movable wagons includes a stationary support column standing upright on the upper surface thereof, and a support member fixedly secured to the stationary support column. A plurality of threaded shaft driving units are arranged between the movable platforms and the stationary support columns for adjusting the floor height of each of the movable platforms, and a number of spectators' seats are arranged on each of the movable platforms in the side-by-side relationship. When the spectator seating system is practically used, the spectators' seats are raised up, but when the spectator seating system is not used, they are folded down.

On the other hand, when the spectator seating system is practically used, a lowermost movable platform is expanded in the forward direction to its maximum extent while maintaining a minimum height. The uppermost movable platform is expanded in the forward direction to a minimum extent while maintaining a maximum height. The movable platforms between the lowermost and uppermost platforms are successively expanded one after another in the forward direction to intermediate distances and intermediate heights.

Each of the height adjusting units includes a power source which rotationally drives a threaded shaft having a plurality of male threads formed thereon. The male threads formed on the threaded shaft engage a support member with at least one female thread. The support member is carried by a vertical support column securely fixed to the movable platform.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

Figure 1:
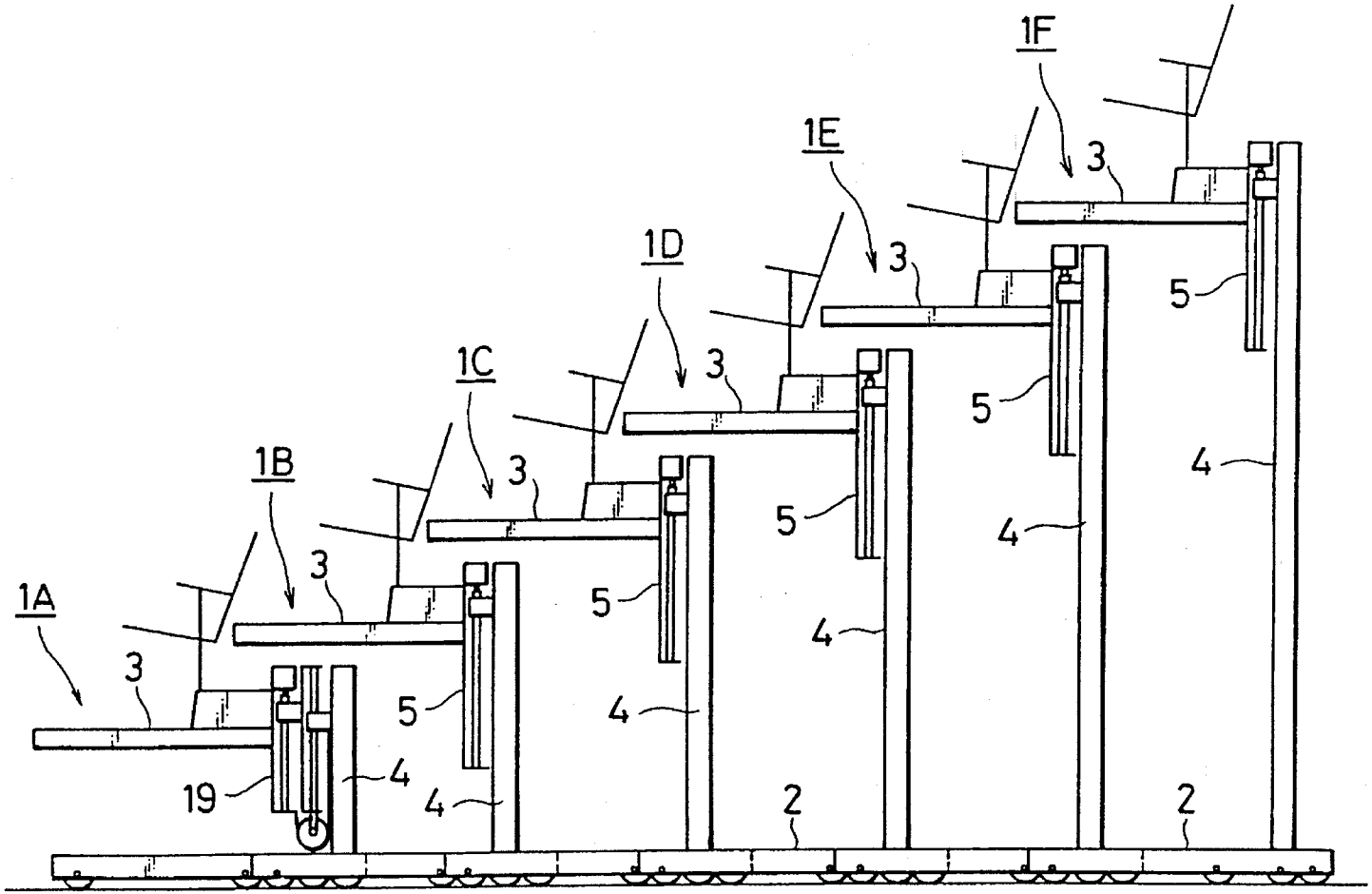
FIG. 1 is a schematic side view of a variable floor height multi-staged spectator seating system constructed in accordance with an embodiment of the present invention, showing the state that a plurality of movable platforms expanded one after another in the forward direction assume in their lowermost positions.
Figure 2:
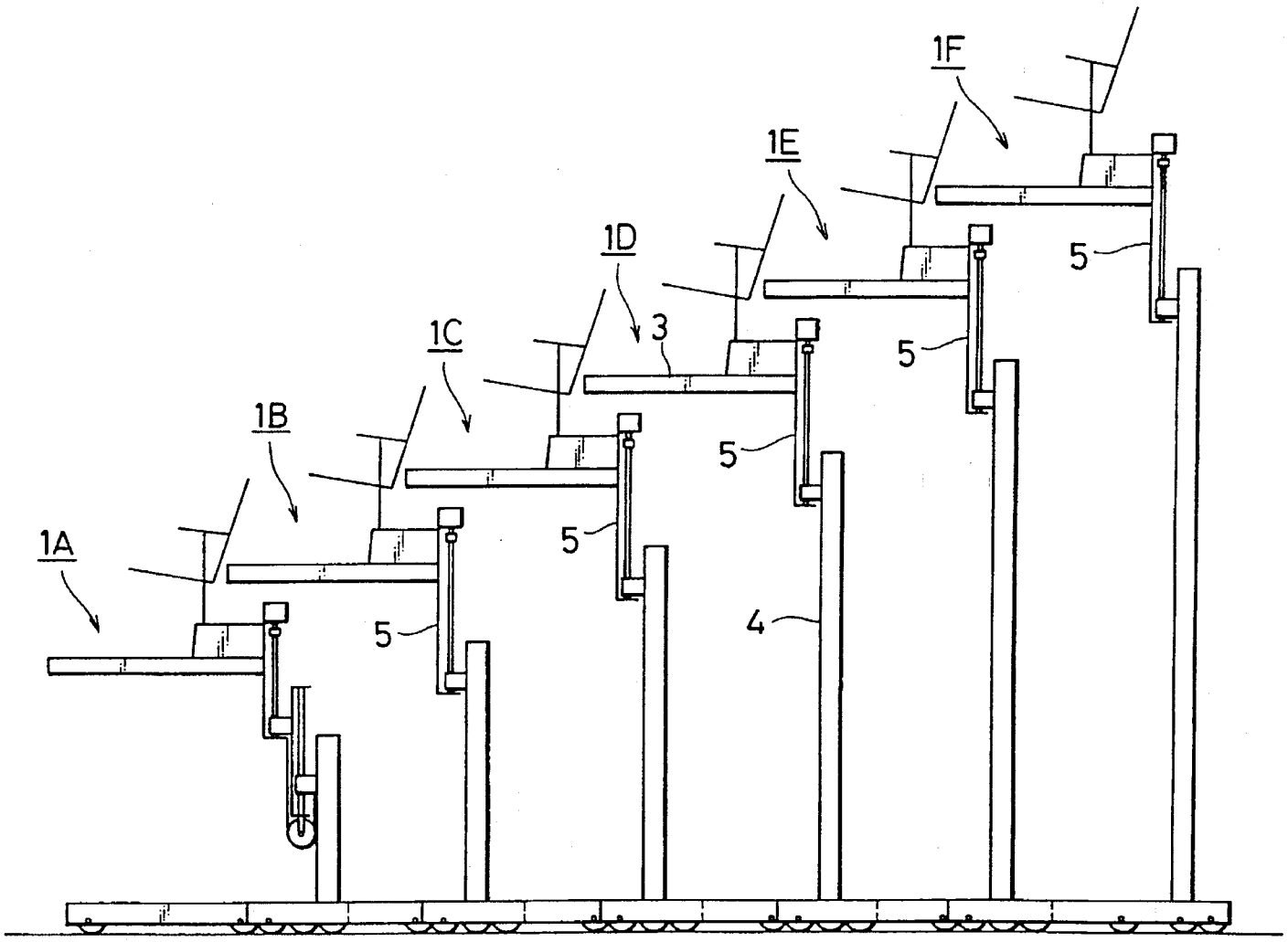
FIG. 2 is a schematic side view of the spectator seating system shown in FIG. 1, showing the state that the respective movable platforms expanded one after another in the forward direction assume in their uppermost positions.
Figure 3:
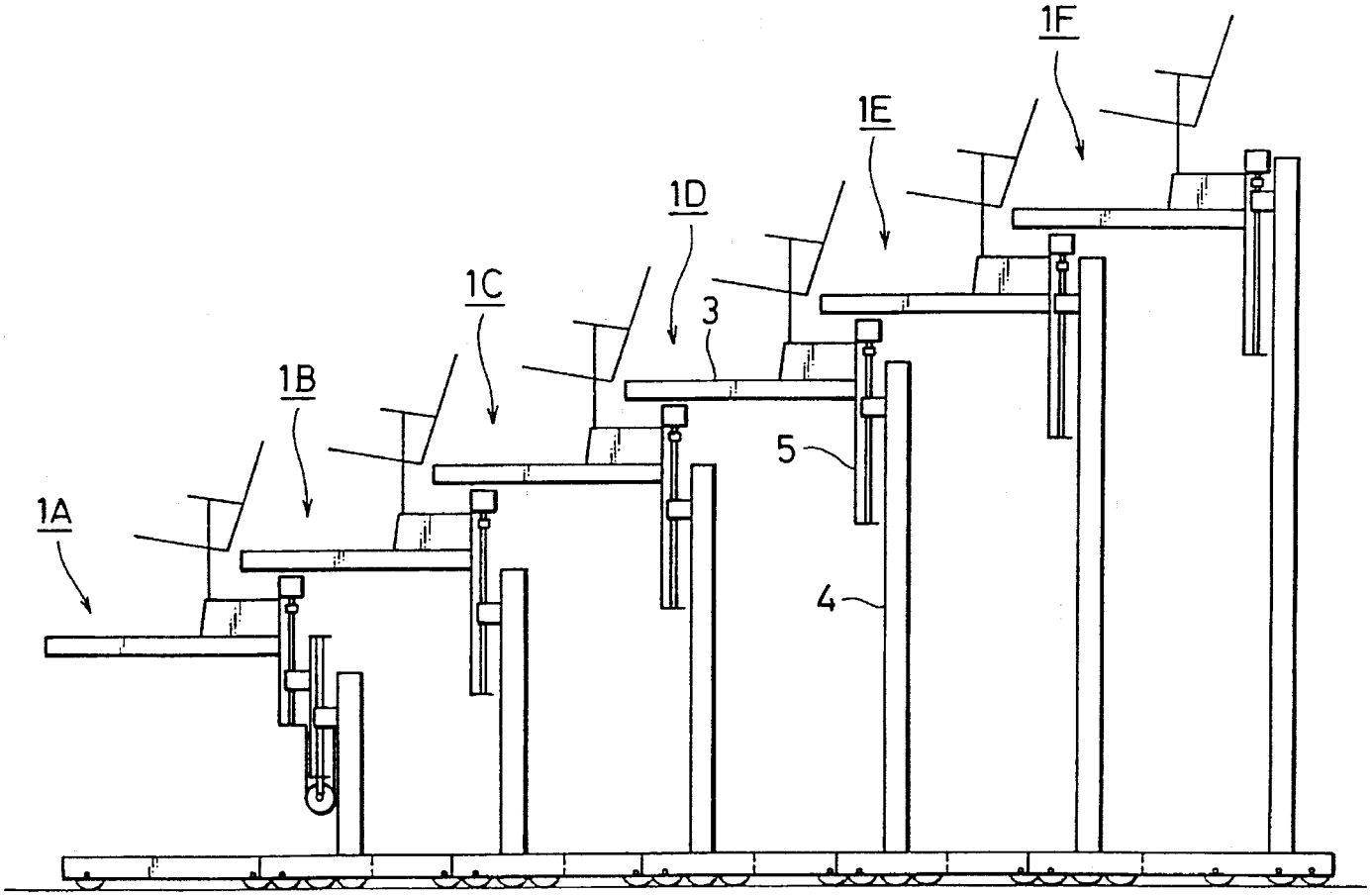
FIG. 3 is a schematic side view of the spectator seating system shown in FIG. 1, showing the state that the respective movable platforms expanded one after another in the forward direction assume in their intermediate positions as seen in the vertical direction.

FIG. 1 to FIG. 3 show by way of schematic side views the structure of a variable floor height telescopic multi-staged spectator seating system (hereinafter referred to simply as a spectator seating system) constructed in accordance with an embodiment of the present invention, respectively, wherein the spectator seating system includes a plurality of movable platforms 1A, 1B, 1C, 1D, 1E and 1F which are successively displaced one after another in the forward direction to assume their expanded state. Specifically, FIG. 1 shows the operative state that a plurality of raising and lowering support columns 5 on each movable platform are lowered to assume their lowest positions, FIG. 2 shows the operative state that the support columns 5 are raised up to assume their uppermost positions, and FIG. 3 shows the operative state that the support columns 5 are held at the desired intermediate positions between the lowermost positions and the uppermost positions. It should be noted that a plurality of raising and lowering support columns 5 and a plurality of spectators' chairs stand upright on the respective movable platforms 1A, 1B, 1C, 1D, 1E and 1F but one support column 5 and one spectator's chair are shown on each movable platform for the purpose of simplification of illustration.

Figure 4:
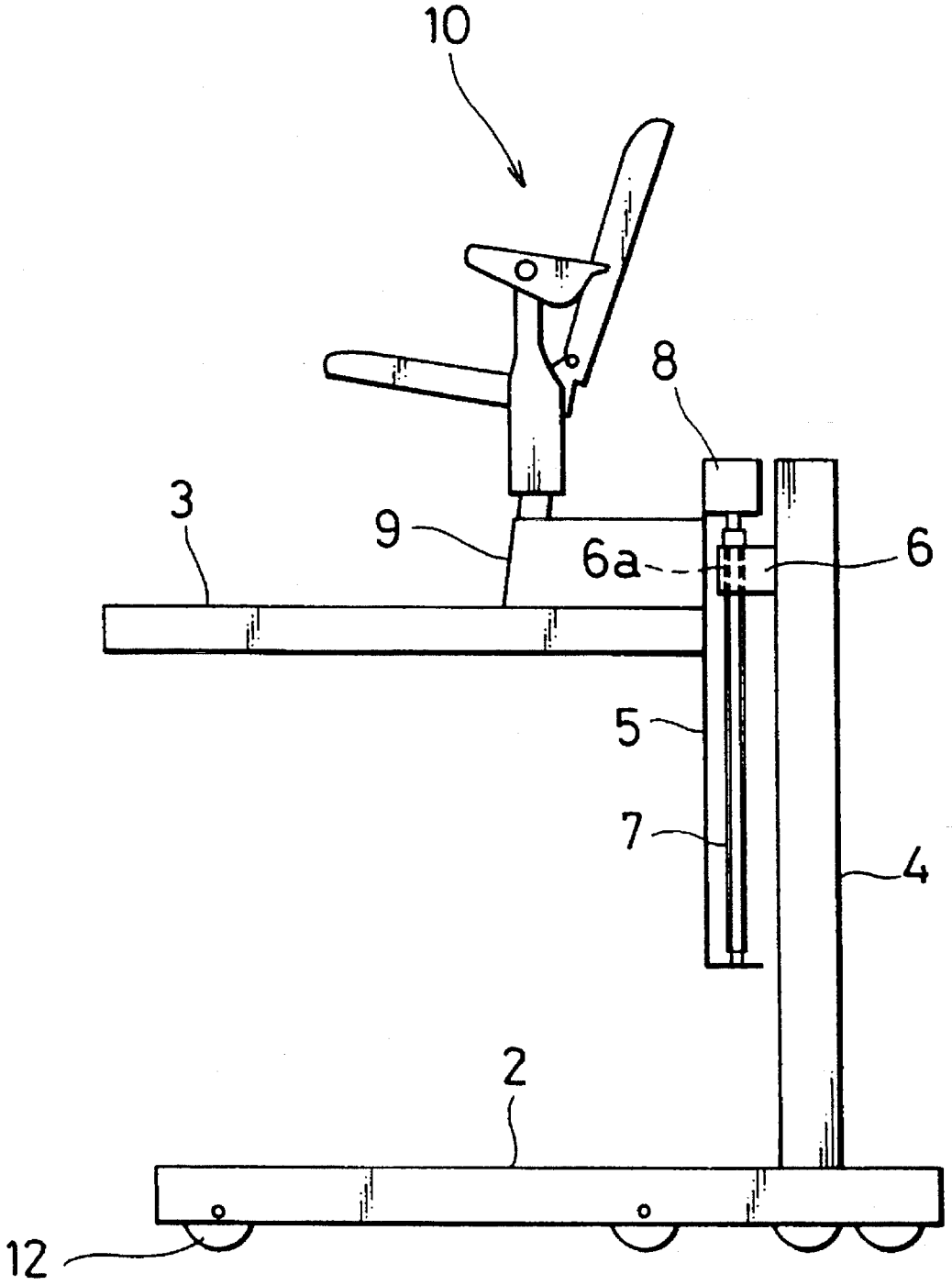
FIG. 4 is a fragmentary enlarged side view of the spectator seating system shown in FIG. 1, showing the state that the movable platforms at the second stage to the sixth stage assume in their lowest positions.
Figure 5:
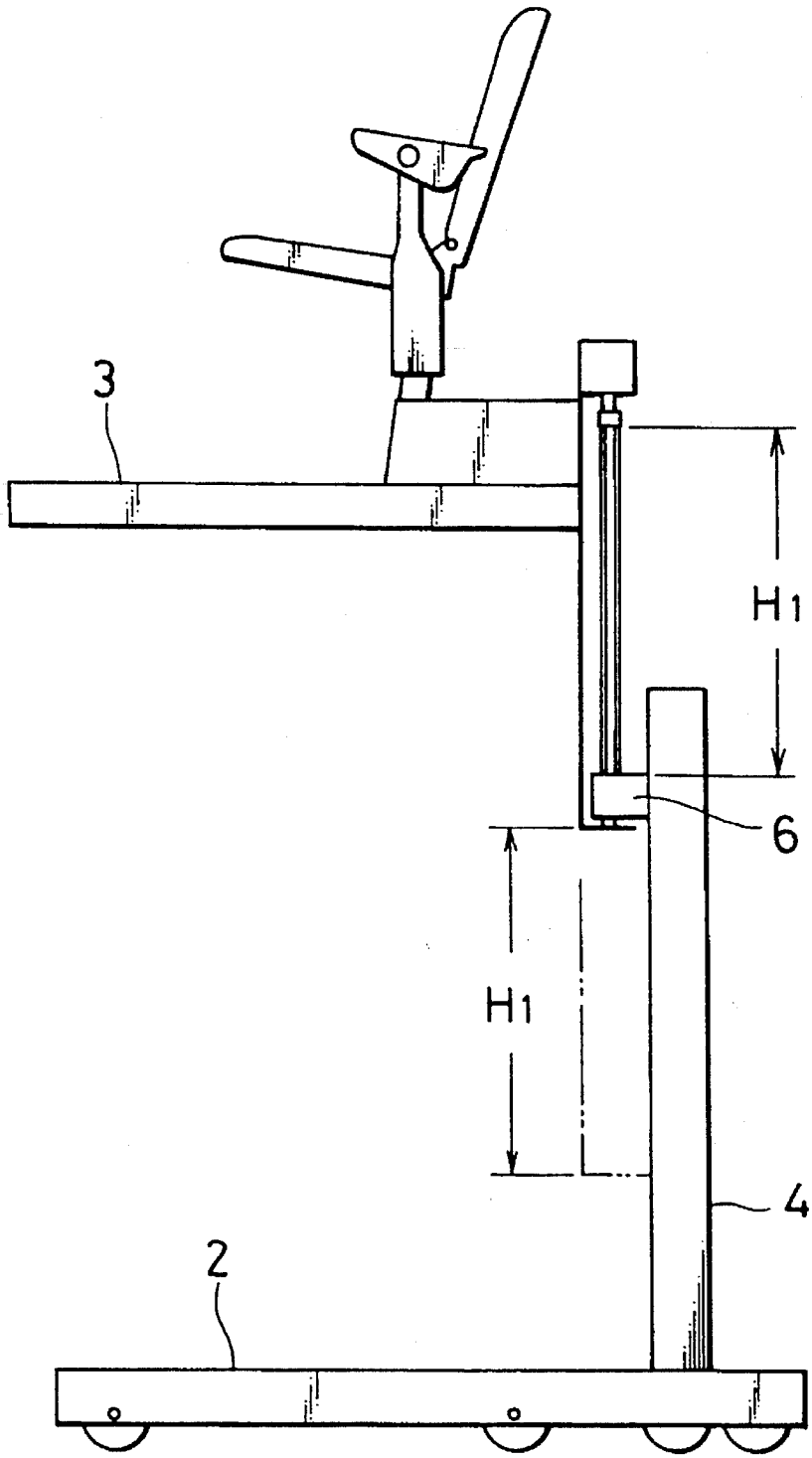
FIG. 5 is a fragmentary enlarged side view of the spectator seating system shown in FIG. 1, showing the state that the movable platform at the second stage to the sixth stage assume in their uppermost positions.

FIG. 4 and FIG. 5 are enlarged side views of second to sixth movable platforms 1B, 1C, 1D, 1E and 1F, respectively.

FIG. 4 shows the operative state that a movable platform is lowered to assume a lowest position. A stationary support column 4 stands upright on a movable wagon 2, and a support member 6 is fixedly secured to the support column 4. In addition, a raising and lowering support column 5 is fixedly secured to a floor portion 3 of the movable platform, and a threaded shaft driving unit 8 is mounted on the raising and lowering column 5.

The threaded shaft driving unit 8 is constructed in the following manner.

A threaded shaft 7 is rotatably supported on the raising and lowering support column 5 with a vertical attitude, and the threaded shaft driving unit 8, such as a motor or the like, disposed on the raising and lowering support column 5 is operatively connected to the threaded shaft 7. A plurality of female threads 6*a* are formed in the support member 6, and a plurality of male threads formed on the threaded shaft 7 are threadably engaged with the female threads 6*a* formed in the support member 6.

A turning up/and down unit 9 is arranged on the floor portion 3 of the movable platform for rotatively supporting a chair 10 on the floor portion 3. In FIG. 4, reference numeral 12 designates a plurality of moving wheels. Since the turning up/down unit 9 for the chair 10 does not form any part of the present invention, description on the turning up/down unit 9 is herein omitted for the purpose of simplification.

When the threaded shaft 7 is rotated by the threaded shaft driving unit 8 while the movable platform is lowered to the lowest position as shown in FIG. 4, the raising and lowering support column 5 is raised up by a distance $H_1$ until it reaches a highest position shown in FIG. 5.

Figure 6:
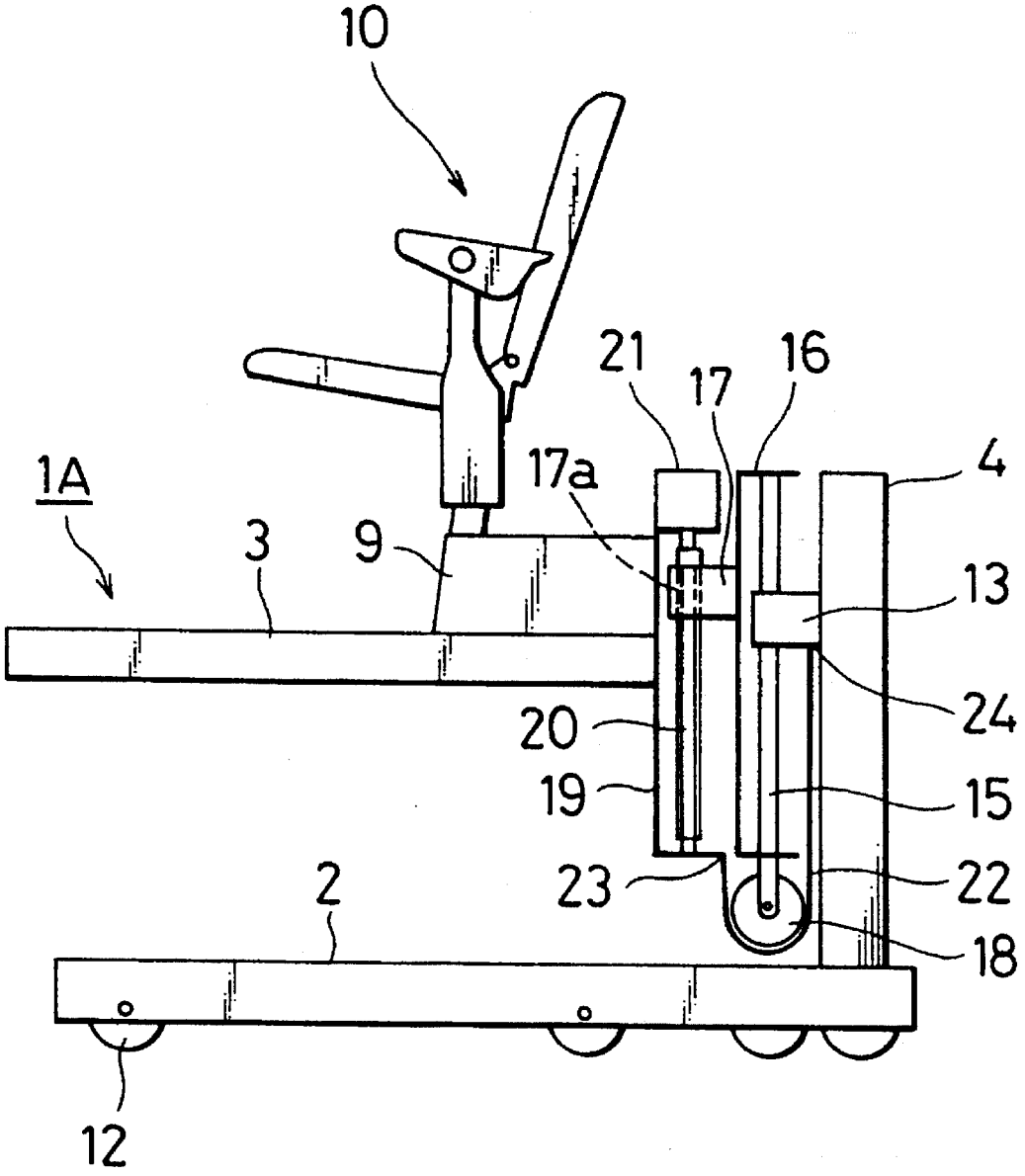
FIG. 6 is a fragmentary enlarged side view of the spectator seating system shown in FIG. 1, showing the state that the movable platform at the first stage assumes in its lowest position.
Figure 7:
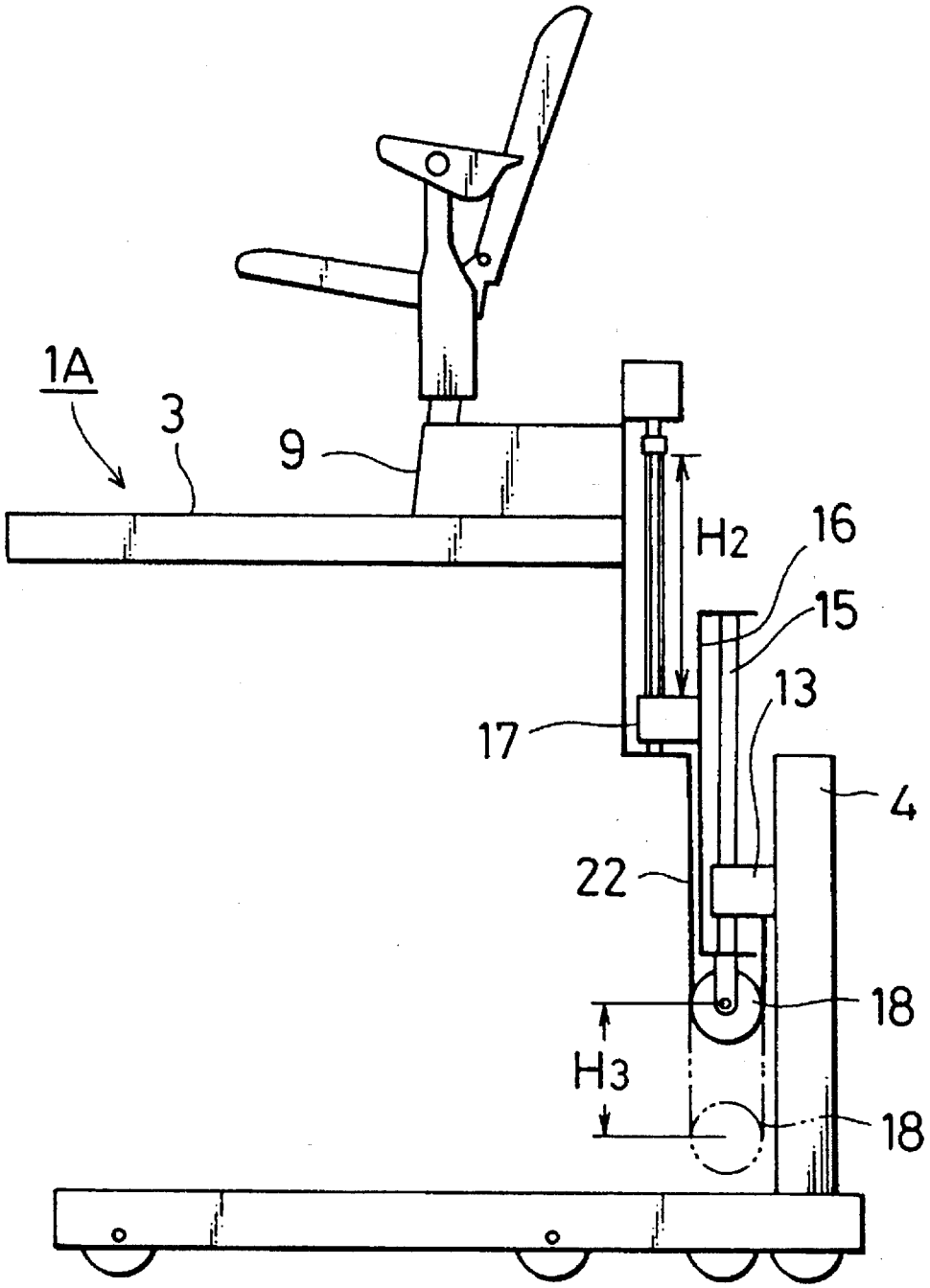
FIG. 7 is a fragmentary enlarged side view of the spectator seating system shown in FIG. 1, showing the state that the movable platform at the first stage assumes in its highest position.

FIG. 6 and FIG. 7 show by way of side views the structure of a movable platform at the first stage constructed in accordance with another embodiment of the present invention, respectively.

Since the movable platform 1A at the first stage normally has a small floor height, the length of a threaded shaft 20 is limitatively determined. To cope with this problem, a pulley driving unit having the following structure is arranged on the first movable platform 1A at the first stage so as to enable the height of the movable platform 1A to be adjusted within the wide range.

In the embodiment shown in FIG. 6, a guide holder 13 is fixedly secured to a stationary support column 4 so that a raising and lowering guide shaft 15 can be raised up and lowered in the vertical direction with the aid of the guide holder 13. An intermediate raising and lowering support column 16 and a support member 17 having a plurality of female threads 17*a* formed therein are fixedly secured to the raising and lowering shaft 5, and a pulley 18 is rotatably held below the intermediate raising and lowering support column 16 with the aid of the raising and lowering guide shaft 15.

A raising and lowering support column 19 is fixedly secured to the movable platform 1A, a threaded shaft 20 is rotatably mounted on the raising and lowering support column 19, and a plurality of male threads formed on the threaded shaft 20 are threadably engaged with the female threads 17*a* formed in the support member 17. A threaded shaft driving unit 21, such as a motor or the like, is disposed on the raising and lowering support shaft 19, and a threaded shaft 20 is operatively connected to the threaded shaft driving unit 21 with a perpendicular attitude. An elongated joint member 22, such as a chain, a wire rope or the like, is caused to extend around the pulley 18 disposed below the intermediate raising and lowering support column 16 in such a manner that one end of the joint member 22 is fastened to the raising and lowering support column 19 at a joint point 23 and the other end of the same is fastened to the stationary support column 4 at a joint point 24. A turning up/down unit 9 is arranged on a floor portion 3 of the movable platform 1A so that a chair 10 is turned up or down with the aid of the turning up/down unit 9 as desired.

Referring to FIG. 6 again, when the threaded shaft 20 is rotated by activating the threaded shaft driving unit 21, the raising and lowering support column 19 starts to be raised up, causing it to pull up the joint member 22 fastened to the raising and lowering support column 4. At this time, since the other end of the joint member 22 is fastened to the stationary support column 4 at the joint point 24, the pulley 18 is increasingly raised up. As the pulley 18 is raised up in that way, the intermediate raising and lowering support column 16 and the support member 17 are also raised up. Since the pulley 18 serves as a moving pulley, it is raised up by a distance equal to a half of the length of pulling-up of the joint member 22.

FIG. 7 shows by way of side view the operative state that the movable platform 1A is raised up to reach a highest position. It is desirable that a sum of the raised-up height $H_2$ of the threaded shaft 20 and the raised-up distance $H_3$ (which is equal to a half of $H_2$) is dimensioned to be equal to the raising-up distance $H_1$ of each of the second movable platform 1B to the sixth movable platform 1F (see FIG. 5).

Figure 8:
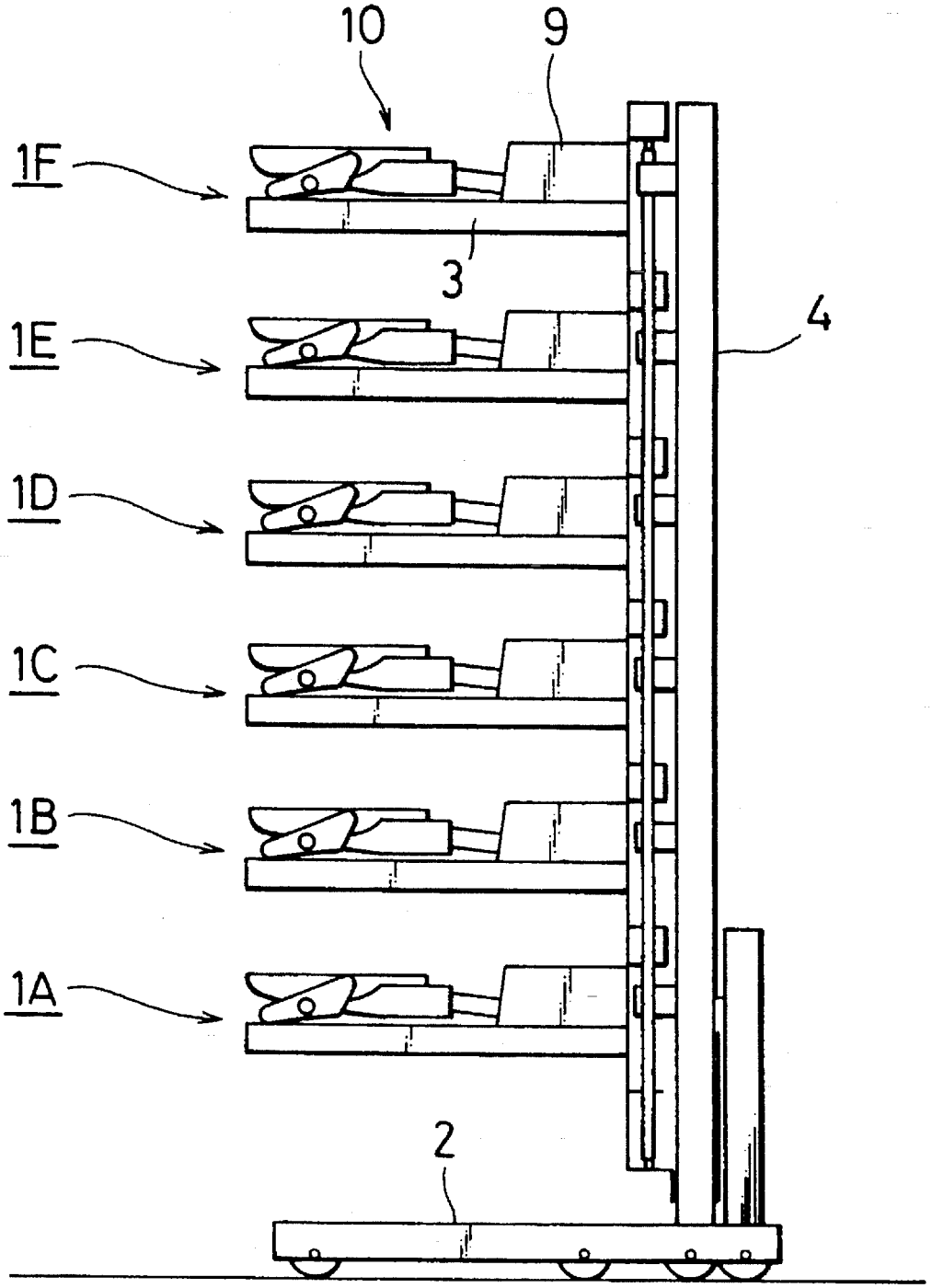
FIG. 8 is a schematic side view of the spectator seating system shown in FIG. 1, showing the state that the respective movable platforms assume when they are retracted to their inoperative positions.

FIG. 8 shows by way of side view the inoperative state that all the chairs 10 are rotatively folded down in the forward direction with the aid of the turning up/down unit 9, and the respective movable platforms 1A to 1F are telescopically contracted in the rearward direction by operating a driving apparatus (not shown) until each of them assumes an accommodated state.

Although the present invention has been described above with respect to the case that the spectator seating system includes six movable platforms, it of course is obvious that the number of movable platforms can arbitrarily be changed to another one.

In addition, in this embodiment, description has been made above with respect to the spectator seating system wherein only the movable platform 1A at the first stage is equipped with a moving pulley unit. Alternatively, it is acceptable that in addition to the movable platform 1A, each of the arbitrary number of movable platforms is equipped with a moving pulley unit.

While the present invention has been described above with respect to two preferred embodiments thereof, it should of course be understood that the present invention should not be limited only to these embodiments but various change or modification may be made without ant departure from the scope of the present invention as defined by the appended claims.

What is claimed is:

1. A variable floor height telescopic multi-staged spectator seating system comprising a plurality of rows of at least one seating unit, each of said rows being moveable laterally between a use position and a retracted position, and being moveable vertically between a raised position and a lowered position, wherein said rows are moveable laterally while in said raised and said lowered positions, wherein said rows are carried by laterally moving bases, each base having an upwardly extending lower support, and each row having a downwardly extending upper support, said upper support and lower support being movably connected together by a rotating threaded rod carried by said upper support and a threaded support member carried by said lower support, and including an adjusting device comprising a motor for driving said threaded rod through said threaded support member.

2. A variable floor height telescopic multi-staged spectator seating system according to clam 1, wherein each of said adjusting devices is independently operable such that said rows may be placed in positions which define a variety of predetermined configurations.

3. A variable floor height telescopic multi-staged spectator seating system according to claim 2, wherein said plurality of rows each include a platform carrying a plurality of seats, wherein said seats are rotatable between upright and stowed positions as said seating units are moved laterally from said use position to said retracted position.

4. A variable floor height telescopic multi-staged spectator seating system comprising a plurality of rows of seating units, each of said rows being moveable laterally between a use position and a retracted position, and each of said rows being moveable vertically between a raised position and a lowered position, wherein said rows are moveable laterally while in said raised and lowered positions, wherein each of said rows includes a moveable platform which is carried by a raising and lowering support column, a shaft movably connected to said support column which is threadably engaged with a support member which is coupled to an intermediate rasing and lowering support column, and a pulley being rotatably held below said intermediate raising and lowering support column and a joint member coupled to said support column and said intermediate support column around said pulley whereby said support member is moveable relative to said intermediate support member by means of said joint member upon movement of said shaft connected to said support member.

* * * * *